United States Patent [19]

McNeel

[11] 4,249,788

[45] Feb. 10, 1981

[54] WATERPROOF MULTIPLE WIRE CABLE CONNECTING DEVICE

[75] Inventor: William O. McNeel, Houston, Tex.

[73] Assignee: Mark Products, Inc., Houston, Tex.

[21] Appl. No.: 972,792

[22] Filed: Dec. 26, 1978

[51] Int. Cl.[3] ..... H01R 4/00

[52] U.S. Cl. ..... 339/94 M; 339/49 R; 339/76

[58] Field of Search ..... 339/94 M, 94 R, 94 A, 339/49 R, 76, 90 R, 122 R, 273 R

[56] References Cited

U.S. PATENT DOCUMENTS

| | | | |
|---|---|---|---|
| 3,745,511 | 7/1973 | Fussell | 339/49 R |
| 4,058,358 | 11/1977 | Carlisle | 339/94 A |

*Primary Examiner*—Neil Abrams
*Assistant Examiner*—DeWalden W. Jones
*Attorney, Agent, or Firm*—Jennings B. Thompson; Marvin B. Eickenroht

[57] ABSTRACT

A waterproof multiple wire electrical cable connecting device is disclosed. The device includes two connector assemblies with each assembly adapted to be connected to the end of a multiple wire electrical cable. Each connector assembly is of the same construction and includes both a male pin type connector and a female socket type connector so that any two connector assemblies can be connected together to connect electrically the conductors in the cables to which they are attached. The male and female connectors of each assembly are mounted in a face plate in side-by-side position to mate with male and female connectors in another assembly. Seal means are provided to seal the connectors of each connector assembly, when assembled with the connectors of another connector assembly, from the ambient environment. The seal means includes a pad or body of elastomeric material having openings through which the pin connectors extend and a thickness such that when the two connector assemblies are connected together, the pad or body of elastomeric material in each connector assembly will be compressed into sealing engagement with the connectors and with each other to isolate the connectors from the ambient environment.

11 Claims, 5 Drawing Figures

WATERPROOF MULTIPLE WIRE CABLE CONNECTING DEVICE

This invention relates to a connecting device for multiple wire electrical cables using pin and socket type connectors and in particular to such a device wherein the pin and socket connectors are sealed from the ambient environment when connected together.

U.S. Pat. No. 3,745,511, dated July 10, 1973, discloses a multiconductor cable connector connecting device that includes two connector assemblies, each having a male or pin connector and a socket or female connector, mounted in side-by-side relationship for connecting to corresponding male and female pin and socket type connectors on the other assembly. The two assemblies are locked together by locking rings carried by one of the connectors on each assembly.

It is an object of this invention to provide a similar connecting device which has an improved seal arrangement for sealing the connected pin and socket connectors from the ambient environment.

These and other objects, advantages and features of this invention will be apparent to those skilled in the art from a consideration of this specification, including the attached drawings and appended claims.

Figure 1:
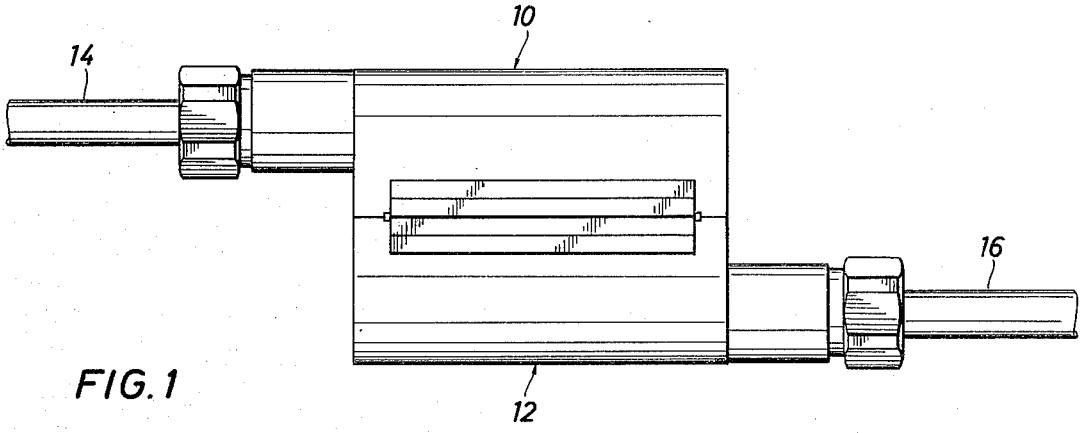
FIG. 1 is a side view in elevation of the preferred embodiment of the connecting device of this invention.
Figure 2:
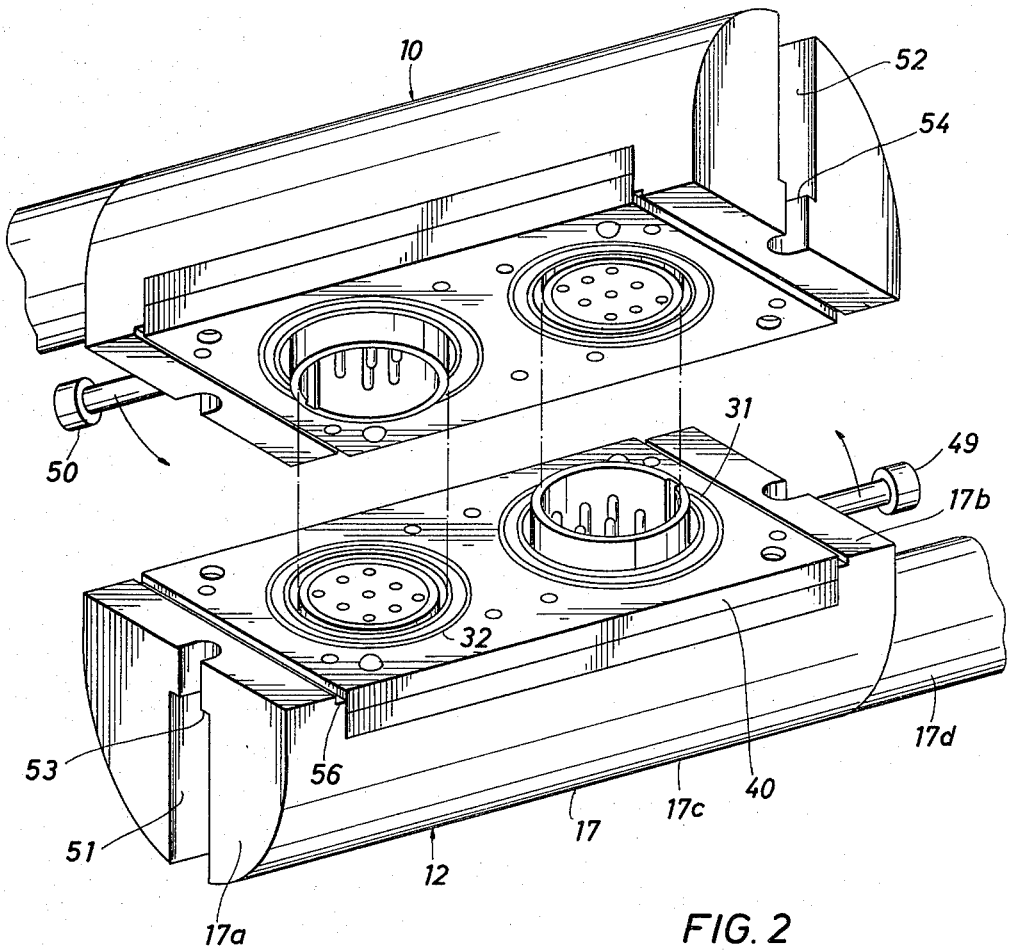
FIG. 2 is an isometric view of the connecting device of FIG. 1 with the two connector assemblies of the connector device in position to be brought together for connecting the two assemblies.
Figure 3:
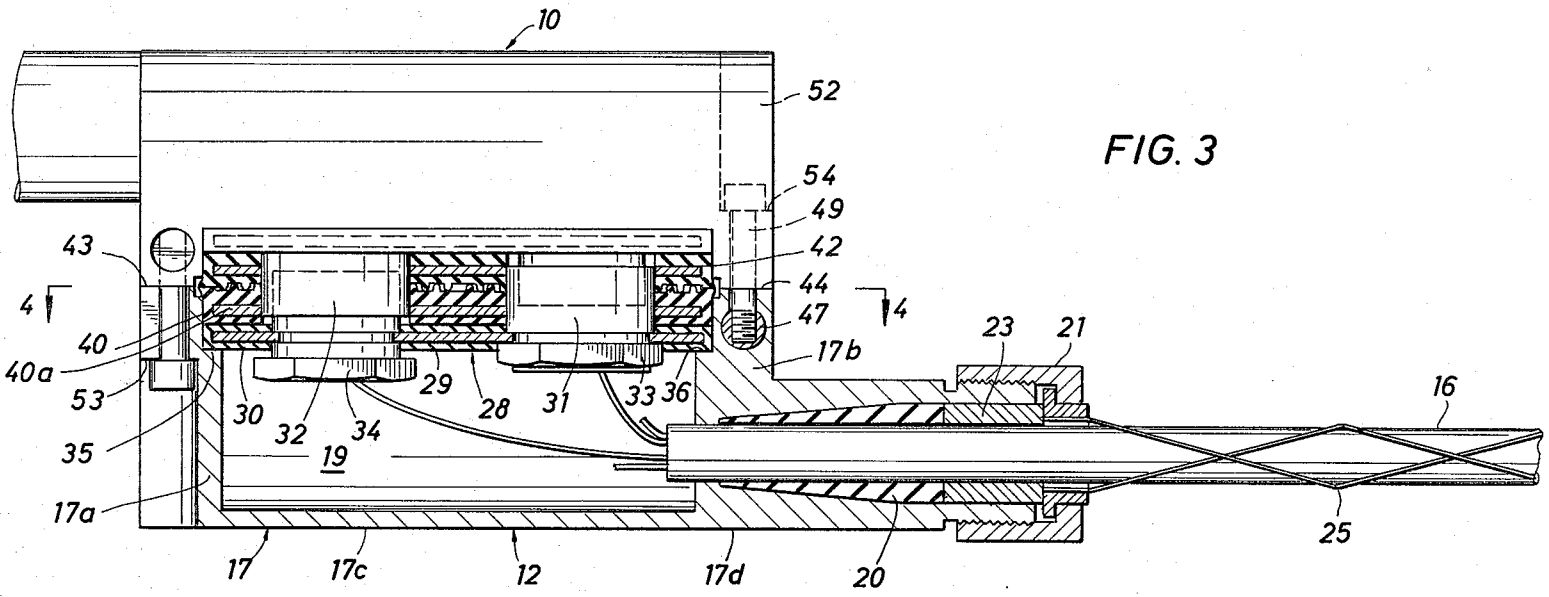
FIG. 3 is a partial sectional view on an enlarged scale of the assembled connector device of FIG. 1.
Figure 4:
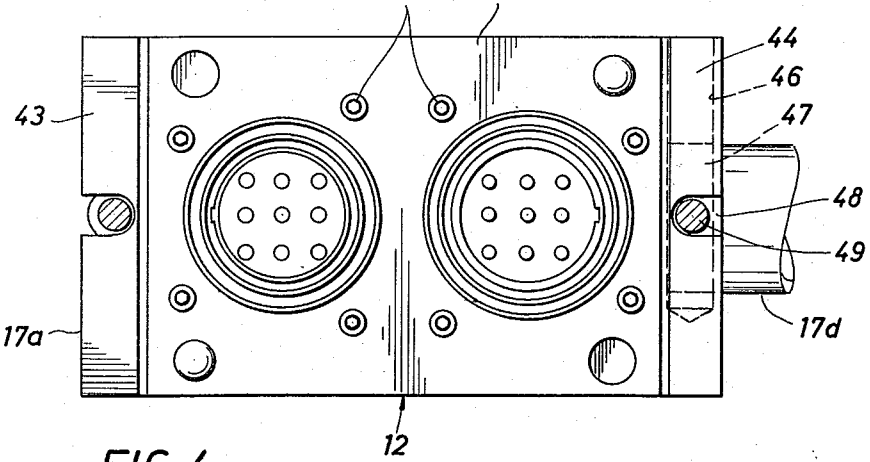

FIG. 4 if a sectional view taken along line 4—4 of FIG. 3; and

Figure 5:
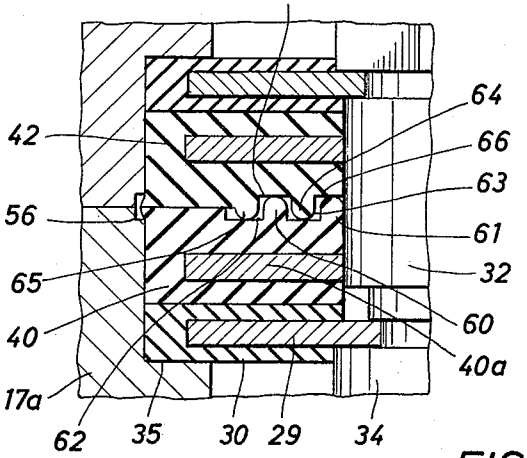

FIG. 5 is a sectional view on an enlarged scale of a portion of the preferred embodiment of the seal means employed with the connecting device of this invention.

The connector device includes two connector assemblies 10 and 12 that are connected to the ends of multiwire electrical cables 14 and 16, respectively. Since connector assemblies 10 and 12 are of identical construction, only one will be described in detail. Specifically, the construction of connector assembly 12, which is shown in section in FIG. 3, will be described.

Connector assembly 12 includes housing or back shell 17, which is generally semi-circular in cross-section. Housing 17 includes semi-circular end walls 17*a* and 17*b* that combine with the semi-circular side portion 17*c* of the housing to provide cavity 19. The housing also includes tubular portion 17*d* that is integrally attached to end wall 17*b*. Tubular portion 17*d* provides an opening through which cable 16 may be inserted into cavity 19 of the housing. The cable is attached to the housing and a seal is provided between the outer sheath of the cable and the housing by longitudinally compressing seal member 20 which is positioned inside tubular section 17*d* of the housing in the outside of the cable. The inside of the opening in which seal member 20 is located is tapered, as shown, as is the outside surface of the seal member so that as the seal member is compressed longitudinally toward the inside of the housing, it will be wedged inwardly in firm engagement with the outer sheath of the cable. The longitudinal compression of the seal member is accomplished by gland nut 21, which engages threads on the outer end of tubular member 17*d* and exerts a longitudinal force on grommet 22 and bushing 23. Wire mesh sleeve 25 surrounds cable 16 and is attached to grommet 22 to help support the weight of the connector assembly when the assembly is picked up by the cable.

The side opposite the semi-circular wall portion 17*c* of the housing is open and it is in this side of the housing that face plate assembly 28 is located. The face plate assembly includes face plate 29 which in the perferred embodiment is embedded in a body of elastomeric material 30. The face plate is a generally rectangular-shaped flat-sided plate of relatively rigid material, such as aluminum and the body of elastomeric material is molded in substantially the same flat-sided plate-like shape. Multiple pin connector 31 and multiple socket or female connector 32 are mounted in side-by-side relationship, as shown in FIG. 3, through openings provided in face plate 29 and elastomeric body 30 by lock nuts 33 and 34 respectively. The face plate assembly closes the open end of housing 17 and is supported by shoulders 35 and 36 in end wall 17*b* and 17*b* respectively, and the opposite edges of side wall 17*c*.

In accordance with this invention, each connector assembly includes seal means for sealing the pin connectors from the ambient environment, when the two connector assemblies are connected together. In the embodiment shown, connector assembly 12 is provided with seal member 40 comprising a generally rectangular shaped body of elastomeric material having openings through which the assembled pin-type connectors extend when the two assemblies are connected together as shown in FIG. 3. A generally rectangular shaped reinforcing plate 40*a* of rigid material is embedded in seal member 40. Seal member 40 is positioned over face plate assembly 28 in the open side of the housing to completely cover the face plate assembly and extend between end wall 17*a* and 17*b* of the housing. Shoulders 35 and 36 and the edges of side wall 17*c* of housing 17 are provided with tapped holes (not shown) and seal member 40 and face plate assembly 28 are provided with openings through which screws 41 extend to securely connect the seal member and the face plate assembly to the housing. Seal member 40 is thicker than the distance between the face plate assembly and upper edges 43 and 44 of end walls 17*a* and 17*b*, respectively. Seal member 42 of connector assembly 10 also protrudes above the end walls of its housing. Thus, when the two connector assemblies are connected together in a manner to be described below, the two seal members 40 and 42 will be compressed, forming a compression seal between each other and between each seal member and the pin and socket connectors as well as with end walls 17*a* and 17*b*. Means are provided for connecting the two assemblies together and for compressing the seal members. In the embodiment shown, opening 46 is drilled into side wall 17*b* from one side of the side wall. Circular pin or shaft 47 is positioned in the drilled hole and is free to ratate around its longitudinal axis in the hole. Groove 48 is milled from upper edge 44 of end wall 17*b* down through hole 44 before pin 47 is placed in the hole. Pin 47 is provided with a tapped opening to receive the threads of cap screw 49. Cap screw 50 is attached to connector assembly 10 in the same manner. On the opposite ends of each housing of the assemblies from the end in which the cap screws are mounted, grooves 51 and 52 are milled. These grooves have a reduced diameter as they approach the end surface of the end walls of the housing forming shoulders 53 and 54. With this arrangement, when the two connector assemblies are moved into position with the pin and socket connectors at least partially assembled, cap screws 49 and 50 are pivoted into position with the heads of the cap screws above shoulders 53 and 54 as shown in FIG. 3. By tightening down on these cap screws evenly, edges 43 and 44 of end wall 17*a* and 17*b* can be pulled into engagement with the corresponding edges of the end walls of the housing of connector assembly 10. This action simultaneously compresses seal members 40 and 42, forcing them into sealing engagement with the connectors, with each other and with the housing to isolate the connectors and also the inside of the housings from the ambient environment.

Since the compressed elastomeric material must have room to move laterally in order to bring the two housings into engagement, relief grooves 56 are provided along the edges of the end walls of each housing. These relief grooves combine to provide a space, as shown in FIG. 5, in which the elastomeric material can flow when the two assemblies are connected together.

In the embodiment shown and in order to provide a more positive seal between the connectors and the ambient environment, seal members 40 and 42 are provided with protruding rings and grooves that mate when the two are in engagement to provide O-ring-type seals around the pin connectors. Specifically, referring to FIG. 5, seal member 40 is provided with spaced protruding rings 60 and 61 and annular grooves 62 and 63. These grooves and protruding rings are arranged to encircle pin connector 32 and the mating pin connector from the other assembly. Seal member 42, in turn, is provided with protruding rings 64 and 65 and annular grooves 66 and 67. The alternate grooves and protruding rings are positioned so that when the two assemblies are assembled, the rings on one member will extend into a groove provided on the other member. For example, groove 62 on seal member 40 receives protruding ring 65 of seal member 42 and so forth. A similar arrangment is provided around the other pin connector. The engagement of the rings and grooves, as stated above, provide an O-ring-type sealing arrangement encircling each of the pin connectors, and provide an improved seal to isolate the connectors from the ambient environment.

From the foregoing, it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and sub-combinations. This is contemplated by and is within the scope of the claims.

As many possible embodiments may be made of this invention without departing from the scope thereof, it is to be understood that all matter herein set forth or shown in the accompanying drawings is to be interpreted as illustrative and not in a limiting sense.

The invention having been described, what is claimed is:

1. A waterproof multiple wire electric cable connecting device comprising, a pair of connector assemblies, each assembly including a housing having an open side bounded by the side and end walls of the housing, at least two opposite walls of the housing having shoulders with outwardly facing surfaces located below the outer edges of the walls, a face plate assembly extending across the open side of the housing in engagement with the outwardly facing surfaces of the shoulders, said face plate assembly including a male pin connector and a female socket connector in side-by-side relationship to mate with a female connector assembly, seal means for combining with the seal means of the other connector assembly to seal the connectors and the open side of the housing from the ambient environment when the two connectors are assembled, said sealing means comprising a body of elastomeric material positioned on the face plate assembly with openings therein through which the male and female connectors extend, said body extending laterally over the shoulders and having a thickness such that it will be compressed between the shoulders and the face plate assemblies of the two connector assemblies into sealing engagement with the side and end walls of the housing, the connectors, and the other sealing means when the pair of connector assemblies are assembled, and means to connect the two assemblies and to compress the seal means.

2. The connecting device of claim 1 in which the face plate of the face plate assembly is embedded in a body of elastomeric material.

3. The connecting device of claim 1 in which the seal means includes raised rings of elastomeric material encircling the connectors.

4. The connecting device of claim 1 in which the seal means is further provided with a raised ring and an annular groove on its outer surface that encircle each connector with the rings positioned to engage the grooves and the grooves positioned to receive the corresponding rings on the surface of the seal means of another connector assembly.

5. A waterproof multiple wire electric cable connecting device, comprising, a pair of connector assemblies, each assembly including a housing having an opening through which the end of a multiple wire electrical cable can be inserted into the housing, said housing having an open side, a male connector and a female connector, means mounting the connectors in side-by-side position in the open side of the housing for connecting to the multiple wires of the cable and to a corresponding male connector and female connector in a second assembly, said mounting means including a mounting plate assembly including a body of elastomeric material with a mounting plate embedded therein, said assembly having openings in which the male connector and female connector are mounted, means for providing a seal between the housing and the connectors and for combining with another assembly to seal the connectors from the ambient environment when the two assemblies are assembled, said sealing means comprising a generally flat-sided body of elastomeric material shaped to snugly fit the opening in the housing in which the connectors are mounted and having openings through which the connectors extend to mate with the connectors on the other assembly, said body having a thickness such that the outside surface extends beyond the housing so that the body will be compressed when the two assemblies are assembled and their housings are drawn together, said seal means being further provided with a raised ring and an annular groove on its outer surface that encircle each connector, the rings are positioned to engage a corresponding groove in the outer surface of the other assembly and the grooves are positioned to receive the rings on the other assembly to form spaced annular seals around the connectors, and means for holding the assemblies in assembled condition and compressing the seal means.

6. A waterproof multiple wire electric cable connecting device comprising, a pair of connector assemblies, each assembly including a housing having an open side bounded by the side and end walls of the housing, said walls having outer edge surfaces, a face plate assembly extending across the open side of the housing and supported by the outer edge surfaces of the walls of the housing, said face plate assembly including a male pin connector and a female socket connector in side-by-side relationship to mate with a female connector and a male connector respectively of the other connector assembly, seal means for combining with the seal means of the other connector assembly to seal the connectors and the open side of the housing from the ambient environment when the two connectors are assembled, said sealing means comprising a body of elastomeric material positioned on the face plate assembly with openings therein through which the male and female connectors extend and extending laterally over the outer edge surfaces of the walls to be compressed between the outer edge surfaces of the walls of the housings and the face plate assemblies of the two connector assemblies into sealing engagement with the side and end walls of the housing, the connectors, and the other sealing means when the pair of connector assemblies are assembled, and means to connect the two assemblies and to compress the seal means.

7. The connecting device of claim 6 in which a portion of the outer edge surfaces of two opposite walls of the housing engage when the two connector assemblies are assembled to limit the compressive force imposed on the seal means.

8. The connecting device of claim 6 further provided with means for connecting the seal means and the face plate assembly to the housing to hold them in place closing the open side of the housing while the two connector assemblies are disassembled.

9. The connecting device of claim 6 in which the face plate assembly includes a body of elastomeric material in which the face plate is embedded.

10. The connecting device of claim 6 in which the seal means includes a rigid reinforcing plate embedded therein.

11. A waterproof multiple wire electric cable connecting device comprising, a pair of connector assemblies, each assembly including a housing and a face plate assembly mounted in one side of the housing, said face plate assembly including a body of elastomeric material, a face plate embedded in the body of elastomeric material, a male pin connector and a female socket connector mounted on the face plate in side-by-side relationship to mate with a female connector and a male connector respectively of the other connector assembly, means for providing a seal between the housing and the connectors and for combining with another connector assembly to seal the connectors from the ambient environment when the two connector assemblies are assembled, said sealing means comprising a body of elastomeric material positioned on the face plate assembly with openings therein through which the male and female connectors extend to be compressed when the pair of connector assemblies are assembled to form a seal between the sealing means of each connector assembly and around the assembled pin connectors, and means for connecting the two assemblies and compressing the seal means.

* * * * *